US006349993B1

(12) United States Patent
Walsh

(10) Patent No.: US 6,349,993 B1
(45) Date of Patent: Feb. 26, 2002

(54) LUMBER SPINAL ALIGNMENT SEAT

(75) Inventor: Andrew C. Walsh, 12 Stornoway Rd., Cumberland Foreside, ME (US) 04110

(73) Assignee: Andrew C. Walsh, Falmouth-Forside, ME (US)

( * ) Notice: Subject to any disclaimer, the term of this patent is extended or adjusted under 35 U.S.C. 154(b) by 0 days.

(21) Appl. No.: 09/721,307

(22) Filed: Nov. 22, 2000

(51) Int. Cl.[7] ..... A47C 31/00
(52) U.S. Cl. ..... 297/466; 297/284.11
(58) Field of Search ..... 297/284.11, 452.25, 297/488, 466

(56) References Cited

U.S. PATENT DOCUMENTS 2,446,470 A * 8/1948 Godwin ..... 297/466 X
4,768,834 A 9/1988 Walsh ..... 297/466
4,813,746 A * 3/1989 Mulholland ..... 297/488
5,342,116 A * 8/1994 Walton ..... 297/466
6,123,392 A * 9/2000 Alfred et al. ..... 297/466 X

* cited by examiner

*Primary Examiner*—Anthony D. Barfield
(74) *Attorney, Agent, or Firm*—Cesari and McKenna, LLP

(57) ABSTRACT

A seat includes a seating platform having a front, a back, opposite sides and a base for supporting the platform above a support surface so that a person can sit on the platform with feet engaging the support surface. A pair of mirror-image thigh restrainers are mounted to the platform at the opposite sides thereof, the restrainers being movable in opposite directions between upright positions wherein they curve toward one another above the platform so that they can engage over the thighs of a person sitting on the platform and a stowed position wherein the thigh restrainers extend down below the platform.

4 Claims, 1 Drawing Sheet

LUMBER SPINAL ALIGNMENT SEAT

BACKGROUND OF THE INVENTION

1. Field of the Invention

This invention concerns apparatus for distributing the weight bearing on the lower back of an individual in the seated position. The invention is particularly helpful for individuals with chronic lower back pain. While the invention is described in the context of a chair, it may also be implemented in other seating platforms including benches and automobile, train and airplane seats where people with chronic back pain must remain seated for prolonged periods.

2. Background Information

The lumbar spinal vertebrae are individual bones in the lower back which are separated from one another by intravertebral discs which function as shock absorbers. The flexibility of the vertebrae comprising the spinal column is controlled to a large extent by the discs, while the stability of the column is maintained in large measure by muscles and ligaments appropriately positioned along the spinal column. Each vertebra consists of a body with which the adjacent discs are in direct contact and posterior portions offset behind the main body, sometimes referred to as facet joints. Basically, the discs cushion the vertical pressure on the spinal column, while the facet joints prevent slippage of one vertebrae on another. They do, however, absorb some vertical pressure.

In childhood and early adult life, each disc consists of a fairly tough outer casing and a soft core or central portion. As the years pass, and depending upon the degree of physical stress imposed on the spine, a process of gradual deterioration occurs in the discs. Partial dehydration of the soft core causes partial shrinkage of the discs, and in the process, loss of some of their shock-absorbing capability. This results in a settling effect of one vertebrae on the next and in an increasing weight bearing on the facet joints of the vertebrae. This increasing pressure on the contact surfaces of those joints as a result of the loss of the shock-absorbing capability of the discs leads to reactive wearing down of the cartilagenous plates on the facet joints' contact surfaces with resulting exposure of the outer surfaces of the bones that are normally protected by the cartilagenous plates. This exposure causes irregular outgrowth of the bone referred to as reactive spurring and sclerosis, resulting in a roughening of the contact surfaces. Such compromised surfaces are more vulnerable to injury or trauma than are the young healthy joints, and when these worn surfaces on the vertebrae are so injured, that often results in considerable lower back pain, requiring protracted periods of treatment. In essence, the facet joints of the vertebrae so injured can cause long periods of fluctuating discomfort which increases with greater levels of activity and, particularly, with repeated or sustained bending or lifting movements. Obesity, pregnancy and other situations which tend to increase the lumbar lordosis can further aggravate the problem of excessive facet joint pressure.

It is known that controlling the lordotic or forward convex curve in the lumbar area of the spine can favorably effect the pressure on the facet joints of the vertebrae, and that such control can rather easily and effectively be achieved through forced contraction of the psoasis major muscles that occupy each side of the lumber spine.

Only relatively recently has it been recognized that forced contraction of the psoasis major muscles may be accomplished by fixing or restraining the fronts or anterior portions of the thighs proximate the knees against upward movement when an individual is in the seated position and presses down with his/her feet. Apparatus for achieving such contraction in order to maintain optimum lumbar spinal alignment while seated is disclosed in my patent U.S. Pat. No. 4,768,834, the contents of which are hereby incorporated by reference herein.

Suffice it to say that in accordance with that patented arrangement, the legs of an individual sitting in a seat are strapped to the seat at locations proximate to the individual's knees so as to maximize the effective lever arm of the thighs in contracting the psoas major muscles. When an individual is restrained in this manner, he or she may force his or her thighs upwardly against the strap while the balls of the feet are pressed downwardly against the surface supporting the seat so as to contract the upper lumber portions of the psoas major muscles. This forced contraction of those muscles causes them to function as lumbar flexors that flatten the lumbar spine. This helps the individual to achieve and maintain optimum lumbar spinal alignment while seated and is effective in relieving chronic back pain.

While that prior arrangement does operate satisfactorily, it does have certain drawbacks. More particularly, the restraining means is in the form of a retractable seat belt whose free end must be secured in order to restrain the seated individual's thighs. This can pose a problem for elderly or infirm people, particularly those with arthritis in the joints of the hands and arms.

That prior apparatus is also relatively expensive to implement because it incorporates a retractor which requires a spring loaded ratcheting mechanism.

Accordingly, it would be desirable to be able to provide an improved and less expensive apparatus for maintaining optimal lumbar spinal alignment while seated.

SUMMARY OF THE INVENTION

It is an object of the present invention to provide an improved seat for maintaining optimum lumbar spinal alignment of a person sitting in the seat.

Another object of the invention is to provide a seat of this type which is easy to use even by old or infirm individuals.

A further object of the invention is to provide such a seat which is relatively easy and inexpensive to retrofit to otherwise more or less conventional seating platforms.

Other objects will, in part, be obvious and will, in part, appear hereinafter.

The invention accordingly comprises the features construction, combination of elements and arrangement of parts which will be exemplified in the following detailed description, and the scope of the invention will be indicated in the claims.

Briefly, the present apparatus comprises a seating platform which may be part of a more or less conventional chair, bench or the like, and is preferably height-adjustable. Rotatably mounted to the seating platform at opposite sides thereof is a pair of fore and aft extending axles. The forward ends of those axles extend just beyond the forward edge of the seat and are connected to a pair of mirror image thigh restrainers. Each such restrainer comprises a relatively wide J-shaped shell which is necked down to adjustably connect to the corresponding axle. The thigh restrainers are rotatable on their axles from a stowed position wherein they repose below the seat to an upright position wherein they engage over the thighs of an occupant of the seat. In the latter position, the occupant may force his/her thighs upward against the thigh restrainers while at the same time pressing the feet downwardly against the floor under the seat. This action contracts the upper or lumbar portions of the occupant's psoas muscles and in so doing flattens his/her lumber spine effectively relieving chronic back pain.

BRIEF DESCRIPTION OF THE DRAWINGS

For a fuller understanding of the nature and objects of the invention, reference should be made to the following detailed description taken in connection with the accompanying drawings, in which.

DETAILED DESCRIPTION OF AN ILLUSTRATIVE EMBODIMENT

Figure 1:
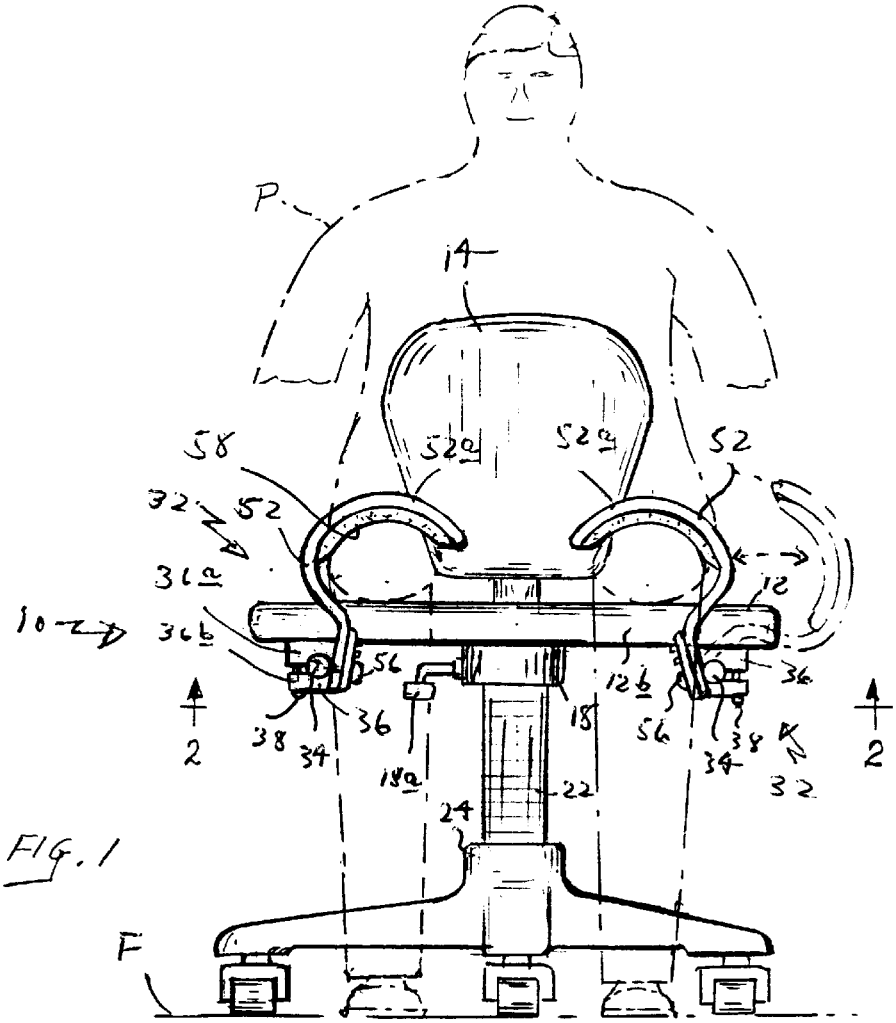
FIG. 1 is an elevational view of a seat for maintaining optimum lumbar spinal alignment of the seat occupant showing the seat's thigh restrainers in their upright positions.

Referring to FIG. 1 of the drawing, a chair incorporating my invention is shown generally at 10. The chair comprises a seat or seating platform 12 for supporting a person P and a back rest 14 connected to the rear of the seat by a heavy leaf spring 16 adjustably secured by a bracket 17 (FIG. 2) to the underside of the seat. Also, mounted to the underside of seat 12 is a bracket 18 for receiving the upstanding post 22 of a more or less conventional chair base 24 which may rest on a floor F. By operating a lever 18*a* on bracket 18, the seat 12 may be raised or lowered relative to base 24 as is well known in the art so that the person's feet may contact floor F.

Figure 2:
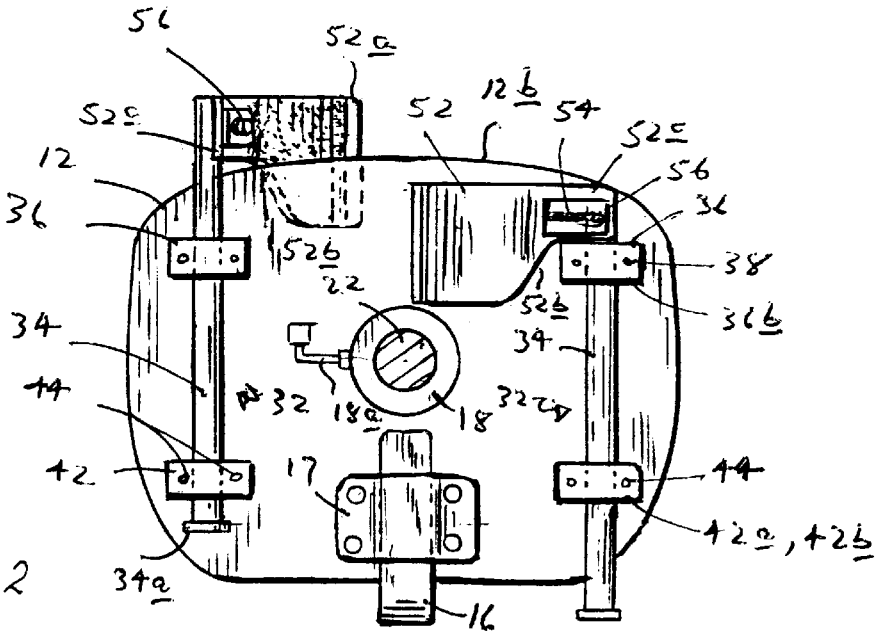
FIG. 2 is a sectional view taken along line 2—2 of FIG. 1 with the thigh restrainers in their stowed positions.

Referring now to FIGS. 1 and 2, a pair of mirror image thigh restraining means shown generally at 32 are mounted to the underside of seat 12 adjacent to the side edges thereof. Each such means 32 comprises an axle 34 which extends parallel to the seat 12 centerline from a point adjacent to the rear edge 12*a* of the seat to a location just beyond the forward edge 12*b* thereof. The forward end segment of each a to the seat by a saddle clamp 36 composed of a first section 36*a* mounted to the underside of seat 12 and extending under axle 34 and a second section 36*b* engaged over the axle and secured to section 36*a* by bolts 38. The rear end segment of axle 34 is similarly secured to the underside of seat 12 by a saddle clamp 42 composed of sections 42*a* and 42*b* secured together by bolts 44.

Mounted to the forward end of each axle 34 is a J-shaped thigh restrainer 52. Each restrainer 52 comprises a relatively wide shell-like section 52*a* which tapers down at 52*b* to a narrower neck 52*c*. Neck 52*c* is formed with at least one lengthwise slot 54 (FIG. 2). The neck is secured to the forward end of axle 34 by bolts 56 or other suitable means extending through each slot 54 and screwed into the axle or a nut on the other side of the axle. The bolts 56 permit adjustment of the thigh restrainer section 52*a* toward and away from the corresponding axle 34.

Each thigh restrainer section 52*a* is curved to correspond more or less to the curvature of the cross-section of an individual's thigh. Preferably that section is somewhat flexible so that it will have some conformability. Preferably also, a resilient pad 58 of foam or other such compliant material is secured to the inside surface of section 52*a* to provide a cushion.

As noted above, the two restraining means 32 are mirror images of one another so that the thigh restrainers 52 face each other. As shown in the drawing figures, the thigh restrainers 52 may be moved between upright positions shown in FIG. 1 and at the left side of FIG. 2 wherein they engage over the thighs of the person P seating in chair 10 and a stowed position shown at the right hand side of FIG. 2 wherein the restrainers are swung down below seat 12. 10 by loosening the bolts 38, 44. Preferably, stops 34*a* are provided at the rear ends of axles 34 to limit the forward movement of the axles. In use, the bolts 38, 44 should be tightened enough to prevent free rotation of the axles, but to permit forced rotation and translation of the axles so that the thigh restrainers 52 can be swiveled and translated between their upright and stowed positions.

To accommodate the girth of the particular seat occupant's thighs, the bolts 56 may be loosened to raise or lower the upright thigh restrainers 52 with respect to seat 12.

It will be appreciated from the foregoing that even old or infirm individuals may use chair 10. Simple arm movements suffice to swing the thigh restrainers 52 to their lower or stowed positions enabling a person to sit on seat 12. Once seated, person P only has to swing up the thigh restrainers 52 so that they engage over his/her thighs as shown in FIG. 1. Then by pressing down on the floor F with the feet, the person P in chair 10 may flatten his/her lumber spine to obtain the benefits described above.

It will also be appreciated from the foregoing that chair 10 may be made in quantity at relatively low cost. For the most part, the chair is a stock item so that the incorporation of the invention only requires the addition of the restraining means 32 which comprise relatively few simple parts which can be made in quantity at relatively low cost.

It will thus be seen that the objects set forth above among those made apparent from the preceding description are efficiently attained. Also, since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention described herein.

What is claimed is:

1. A seat comprising a seating platform having a front, a back, opposite sides and a centerline between said sides;

a base for supporting the platform above a support surface so that a person can sit on the platform with legs hanging down and feet engaging the support surface, and a pair of mirror-image thigh restraining means mounted to the platform at the opposite sides thereof, said restraining means being movable in opposite directions between upright positions wherein they curve toward one another above the platform so that they can engage over the thighs of a person sitting on the platform and a stowed position wherein the thigh restrainers extend down below the platform, each restraining means comprising an axle extending parallel to said centerline between the front and back of the seating platform, said axle having a forward end segment extending beyond the front of the seating platform and a rear-end segment rotatably and slidably mounted to the seating platform;

a thigh restrainer having a J-shaped shell with an arcuate portion having a concave surface and a leg, and fastening means for fastening said leg to the forward end segment of the axle so that the thigh restrainers may be adjusted toward and away from the front of the platform and be swung toward one another to their upright positions so that they engage over the thighs of the seat occupant.

2. The chair defined in claim 1 wherein said fastening means is releasable to permit adjustment of the thigh restrainer in a direction perpendicular to said axles.

3. The chair defined in claim 2 wherein each thigh restraining means further includes a compliant pad engaged to the concave surface of said arcuate segment of each thigh restrainer.

4. The seat defined in claim 2 wherein said base includes means for adjusting the elevation of the seating platform above the support surface.

* * * * *